United States Patent [19]

Sagiv

[11] Patent Number: 4,506,877

[45] Date of Patent: Mar. 26, 1985

[54] AUTOMATIC BIASING MECHANISM FOR PAPER CASSETTE SUPPORT PLATE

[75] Inventor: Oded Sagiv, Ramat-Gan, Israel

[73] Assignee: Savin Corporation, Stamford, Conn.

[21] Appl. No.: 405,183

[22] Filed: Aug. 4, 1982

[51] Int. Cl.[3] ..... B65H 1/08

[52] U.S. Cl. ..... 271/127

[58] Field of Search ..... 271/117, 126, 127, 155, 271/157, 162, 164

[56] References Cited

U.S. PATENT DOCUMENTS

| | | | |
|---|---|---|---|
| 3,655,183 | 4/1972 | Wagner | 271/127 X |
| 4,268,027 | 5/1981 | Oleksiak | 271/157 X |
| 4,327,905 | 5/1982 | Schonfeld | 271/157 X |
| 4,346,878 | 8/1982 | Aizawa | 271/127 X |

*Primary Examiner*—Richard A. Schacher

*Attorney, Agent, or Firm*—Shenier & O'Connor

[57] ABSTRACT

An automatic biasing mechanism for a paper cassette support plate for use in an electrophotographic copier in which a removable paper cassette is provided with a plate upon which a supply of copy sheets is placed. A feed roller assembly within the copier is adapted to remove the uppermost sheets of paper from the cassette and activate a sensor when the top of the stack of sheets falls below a predetermined level. The sensor provides an output energizing a motor to rotate a shaft having a roller adapted to pivot the plate to move the stack of sheets to a position at which the uppermost sheet engages the feed roller assembly. The shaft, normally biased so as not to be in driven engagement with the motor, is moved into operative relationship with the motor by the cassette upon its insertion in the copier.

6 Claims, 5 Drawing Figures

FIG.5
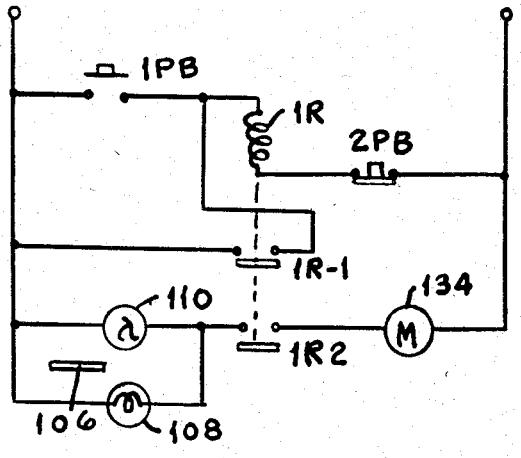
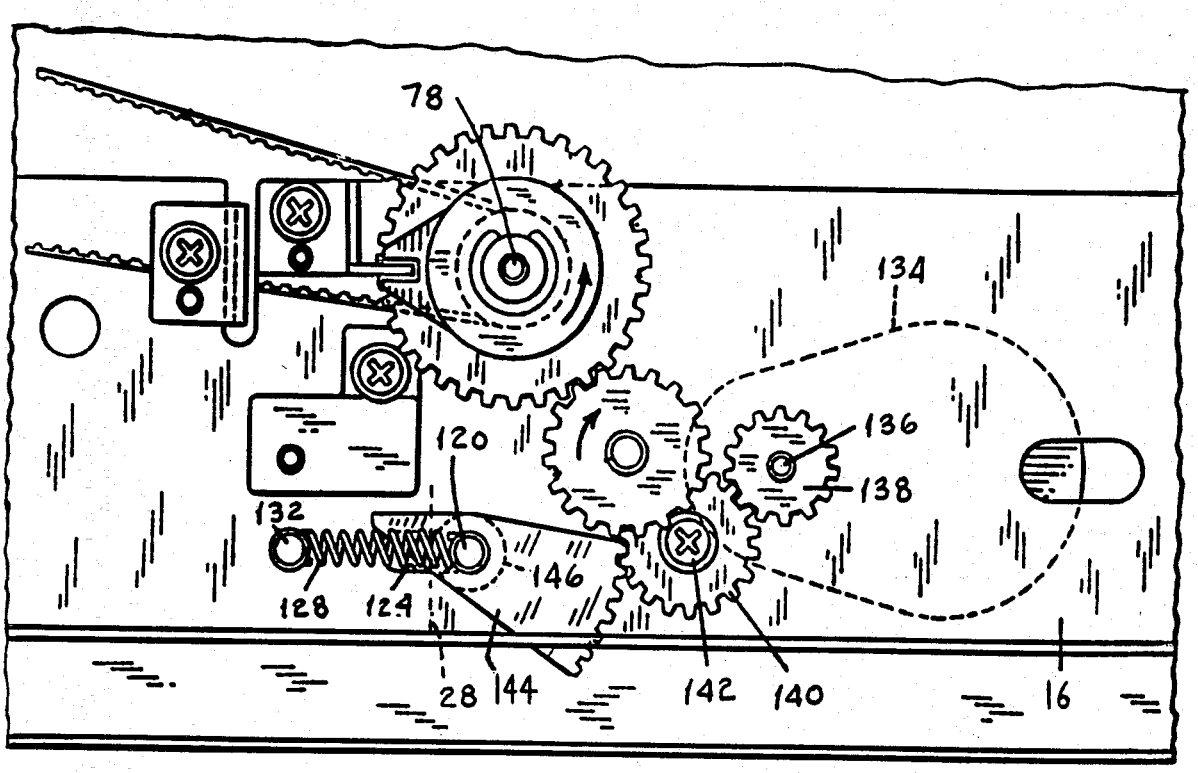
FIG.4

AUTOMATIC BIASING MECHANISM FOR PAPER CASSETTE SUPPORT PLATE

FIELD OF THE INVENTION

My invention relates to a lifting mechanism for a paper cassette support plate and, in particular, to a mechanism for automatically lifting the paper support plate of a cassette in response to assembly of the cassette on an electrophotographic copier.

BACKGROUND OF THE INVENTION

Paper cassettes are used in electrophotographic copiers to store a supply of copy sheets. The cassettes are usually provided with a plate which normally rests on the bottom of the cassette, and upon which the supply of copy sheets is placed. As the supply is depleted, the plate must be raised so that the uppermost copy sheet remains in engagement with the paper feed roller assembly used to remove the sheets from the cassette.

In one type of cassette plate lifting mechanism, a roller is urged upwardly through an opening in the bottom of the cassette and into engagement with the underside of the plate to move the paper supply into engagement with the feed roller. The plate-lifting roller is mounted on an arm carried by a spring-loaded pivot shaft. Means is provided to disengage the loading spring to facilitate insertion and removal of the cassette. Mechanisms of this type either require a manual operation to disable the loading spring or the arrangement must permit the cassette to be moved in and out against the action of the loading spring.

While such arrangements keep the top sheet in engagement with the feed roller, the amount of force used cannot be controlled and varies with the amount of paper in the cassette. This requires the use of an immovable feed roller assembly, the rollers of which must overcome the spring force to remove the copy sheets from the cassette.

One example of a cassette arrangement of the type described is shown in U.S. Pat. No. 3,977,666.

SUMMARY OF THE INVENTION

One object of my invention is to provide an automatic biasing mechanism for a paper cassette support plate which does not interfere with the insertion and removal of the cassette.

Another object of my invention is to provide an automatic biasing mechanism for a paper cassette support plate which maintains the plate at the proper height without the use of excessive force against the feed roller assembly.

Still another object of my invention is to provide an automatic biasing mechanism for a paper cassette support plate which is rendered operative by the insertion of the cassette in a machine and inoperative by its removal from the machine.

Other and further objects of my invention will appear from the following description.

BRIEF DESCRIPTION OF THE DRAWINGS

In the accompanying drawings to which reference is made in the instant specification and which are to be read in conjunction therewith, and in which like reference numerals are used to indicate like parts in the various views:

FIG. 4 is a fragmentary rear elevation of the central portion of the copier with parts broken away, taken along the lines 4—4 of FIG. 3.

FIG. 5 is a schematic diagram of one form of control circuit which can be used with my automatic paper cassette support plate biasing mechanism.

DESCRIPTION OF THE PREFERRED EMBODIMENT

Figure 1:
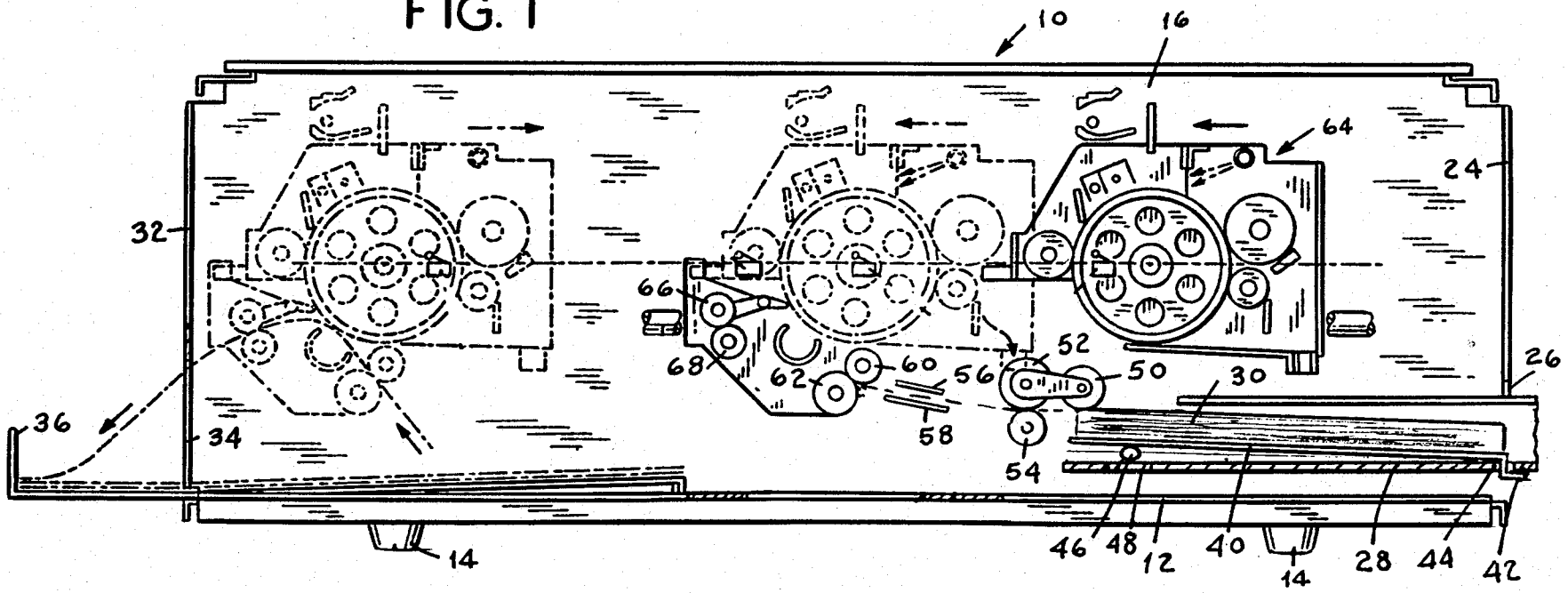
FIG. 1 is a partially schematic front elevation of a cassette type electrophotographic copier with which my automatic paper cassette support plate biasing mechanism may be used, with parts broken away and with other parts shown in section.
Figure 2:
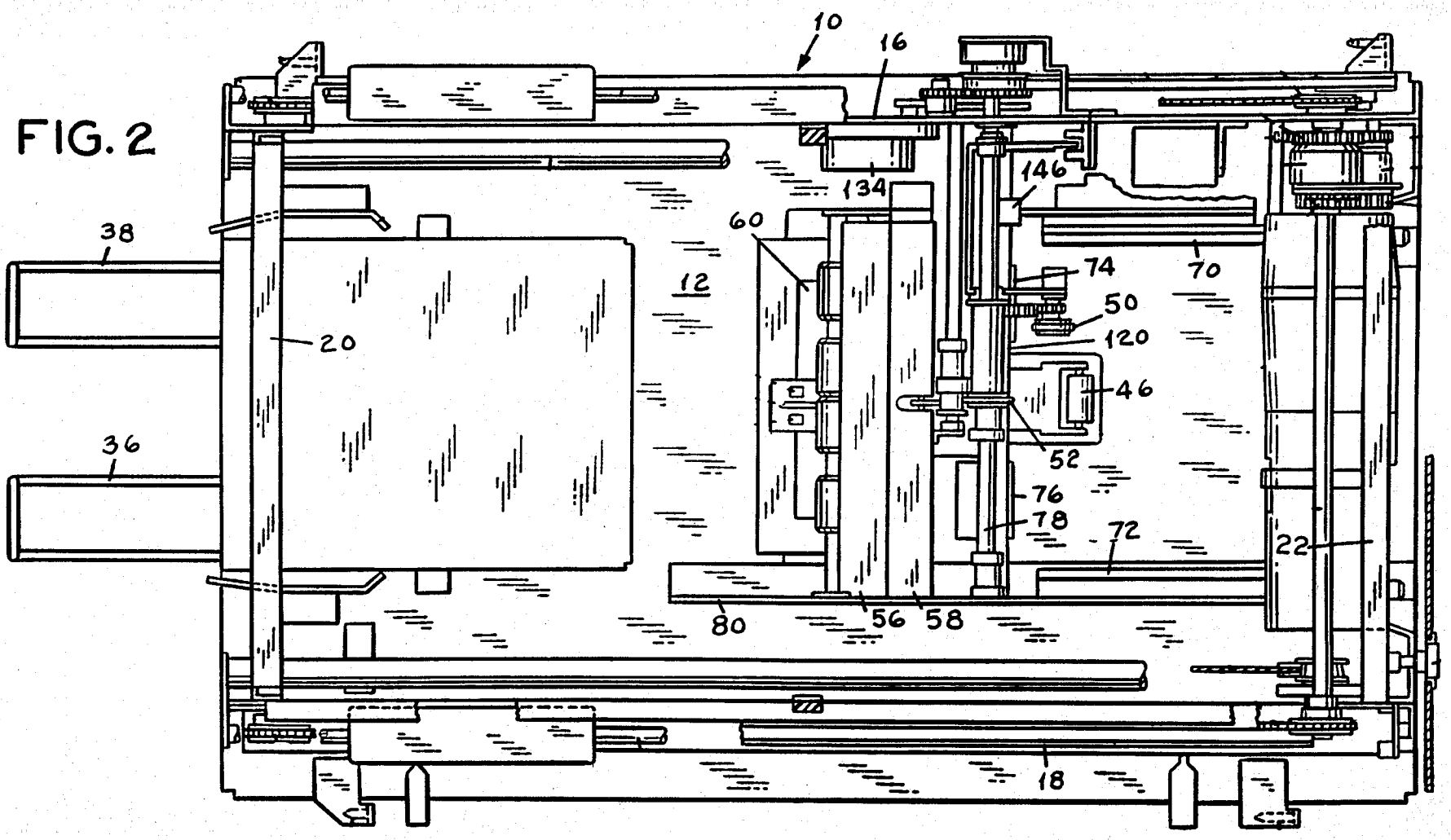
FIG. 2 is a top plan of the copier shown in FIG. 1 with parts removed to illustrate the cassette receiving portion thereof, and with other parts broken away.

Referring now to FIGS. 1 and 2 of the drawings, an electrophotographic copier indicated generally by the reference character 10, with which my improved cassette tray lifting mechanism may be used, includes a base 12 supported by a plurality of feet 14. A rear wall 16 and a front wall 18 extending upwardly from the base 12 are connected at the upper left ends thereof by a first cross piece 20 and at the upper right ends thereof by a second cross piece 22. Any suitable means may be employed to secure the crosspieces 20 and 22 to the front and rear walls 18 and 16. The machine 10 is shown and described in detail in the copending application Ser. No. 268,261, filed May 29, 1981, by Benzion Landa for Improved Method and Apparatus for Electrophotography.

A right end cover 24, secured to the front and rear walls by any suitable means, has an opening 26 through which a cassette 28 containing a supply of paper 30 can be inserted into the copier 10. A left-hand cover 32 secured to the front wall and rear wall by any suitable means, has an opening 34 through which the finished copy is passed to a pair of tray forming members 36 and 38.

The cassette 28 includes a paper support plate 40 which normally rests on the bottom of the cassette. Plate 40 is formed with a pair of feet 42, only one of which is shown, which are adapted to extend through openings 44 in the bottom of the cassette 28, allowing the plate 40 to be pivoted. A roller 46 is adapted, in a manner to be more fully described hereinbelow, to act on plate 40 through an opening 48 in the bottom of the cassette 28 to bring the uppermost sheet of paper in the cassette into engagement with a paper pre-feed roller 50.

Roller 50, together with feed roller 52, and separation roller 54 serve to advance one sheet of paper through paper guides 56 and 58 to a pair of registration rollers 60 and 62. Rollers 60 and 62, in a manner known to the art, advance the sheet through the transfer station of an electrophotographic processing unit, indicated generally by the reference character 64. Exit rollers 66 and 68 deliver the sheet to tray forming members 36 and 38.

Figure 3:
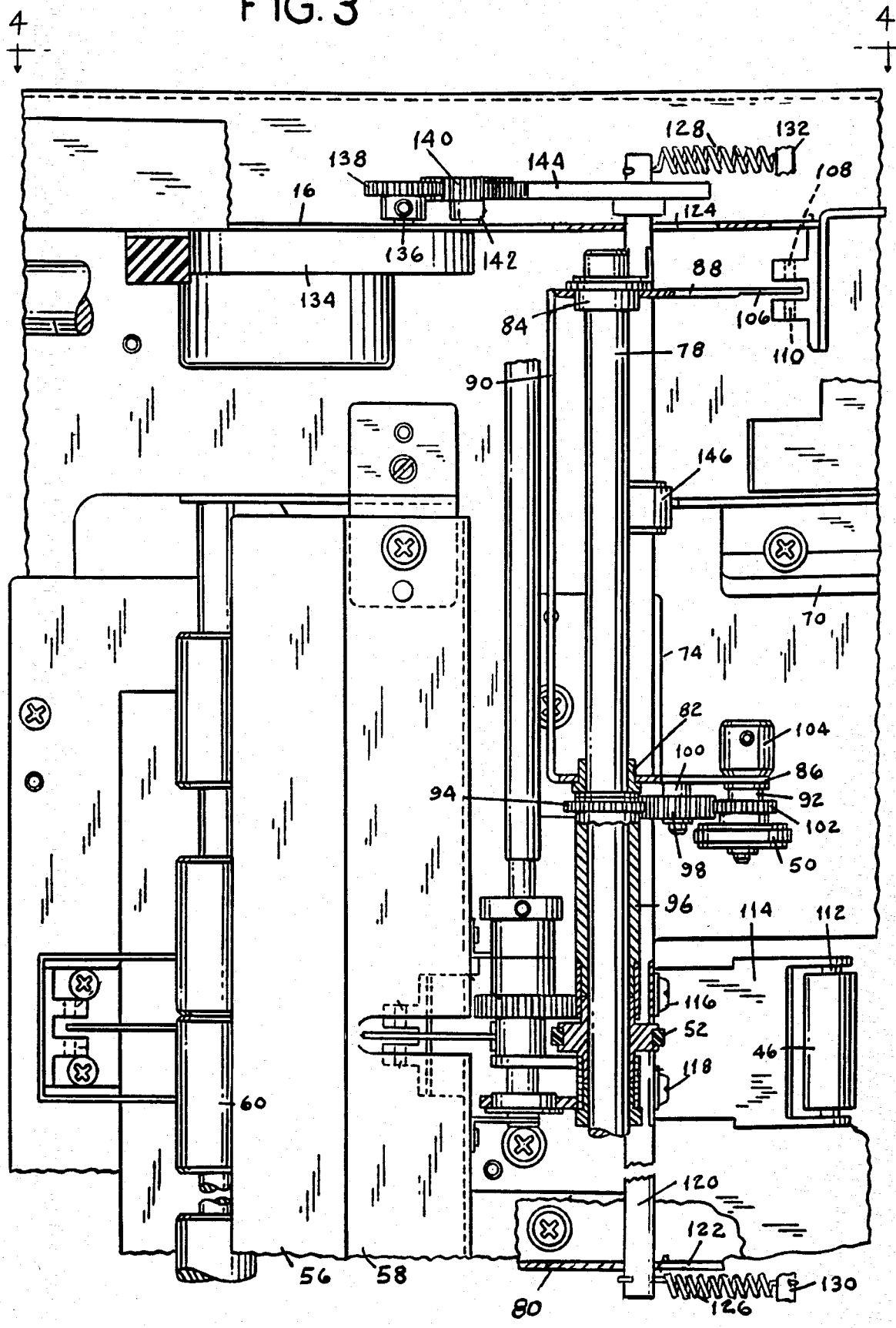
FIG. 3 is a fragmentary top plan of my improved cassette tray lifting mechanism drawn on an enlarged scale with parts removed and with other parts shown in section.

Referring now to FIGS. 2, 3 and 4, the copier 10 includes rear and front cassette guide assemblies 70 and 72 which guide the cassette 28 into its operative position in the copier, in which it may be held, for example by magnets or the like carried by brackets 74 and 76 extending from the base 12.

A shaft 78 rotatably supported in the rear wall 16 and a frame member 80, receives bushings 82 and 84 in the arms 86 and 88 of a paper pickoff roll bracket 90. Arm 86 supports a shaft 92 carrying the paper pre-feed or pickoff roller 50 which engages the uppermost sheet of paper in the cassette 28 in normal operation of the copier. A gear 94 carried by a sleeve 96 on shaft 78 is adapted to be driven to drive a gear 98 carried by a shaft 100 on arm 86. Gear 98 drives a gear 102 on shaft 92 to drive pre-feed roller 50. A weight 104 on shaft 92 biases the roller 50 downwardly.

I form arm 88 with a shutter portion 106 adapted to move into the space between a light source 108 and a photosensitive element 110 when roller 50 is in its operative position, a position at which it may remove the top sheet of paper from the cassette.

Roller 46 is carried by a pin 112 supported by an arm 114 which is connected by screws 116 and 118 to a pivot shaft 120. Shaft 120 may be rotated to move roller 46 upwardly through the opening 48 in the cassette 28 in a manner to be described, to engage the cassette plate 40 to move the stack of sheets 30 therein to a position at which the uppermost sheet is in engagement with the paper pre-feed roller 50. The ends of the shaft 120 are supported in a pair of slots 122 and 124 in walls 80 and 16. Springs 126 and 128 extending between the ends of shaft 120 and respective pins 130 and 132 on walls 80 and 16, normally urge shaft 120 from the position shown in FIG. 3 to the opposite corresponding ends of slots 122 and 124.

A motor of a motor and reduction gear assembly 134 is adapted to be energized to drive a shaft 136 carrying a gear 138 which meshes with an idler gear 140 supported on a shaft 142 and adapted to engage a segmental gear 144 carried by the shaft 120 for movement therewith.

Referring now to FIG. 5, one form of control circuit which can be used with my mechanism includes a first push-button switch 1PB adapted to be actuated when the machine is turned on to energize a relay winding 1R through a "stop" push-button switch 2PB. Momentary energization of winding 1R closes a first switch 1R-1 to complete a holding circuit for the winding. Energization of winding 1R also completes the circuit of motor 134 through the photoconductive device 110 which is rendered conductive by light from source 108.

In operation of the arrangement just described, springs 126 and 128 normally urge the pivot shaft 120 to a position in which the segmental gear 144 is out of engagement with gear 140 with no cassette 28 in the copier. In this position, as shaft 120 may rotate freely, the weight of roller 46 causes it to fall to the base 12 below the upper edge of cassette guides 70 and 72, so as not to interfere with the subsequent insertion of the cassette. With the copier 10 turned on and before a cassette is inserted into the machine, the motor 134 is energized in the manner described. When a cassette is inserted into the machine, it engages a sleeve 146 on shaft 120 to move the ends of shaft 120 to the other ends of the slots 122 and 124 so that segmental gear 144 is in engagement with gear 140. The magnets on brackets 74 and 76 are sufficiently strong to hold the cassette 28 in place against the action of springs 126 and 128. Under these conditions the segmental gear 144 is driven in such a direction as to move the roller 46 upwardly and into engagement with the cassette paper support plate 40 to move the stack of paper 30 in the cassette upwardly to bring the uppermost sheet thereof into engagement with the pre-feed roller 50. As this action takes place, the bracket 86 is pivoted until the shutter portion 106 moves into the space between the light 108 and the photosensitive element 110. When that occurs element 110 is rendered non-conductive, motor 134 is de-energized and the copier is ready to feed paper.

As the supply of paper in the cassette is depleted, feed roller 50 moves downwardly under the influence of gravity until shutter 106 moves out of the space between the light source 108 and the photo-conductive element 110 to reestablish the circuit of motor 134. Shaft 120 is thus driven to move roller 46 upwardly until shutter 106 again moves into the space between source 108 and element 110. It will readily be appreciated that the parts will stay in the positions to which they have been moved so long as the cassette is in place.

As the cassette 28 is removed for servicing or refill, sleeve 146 is disengaged, allowing springs 126 and 128 to pull shaft 120 towards the corresponding opposite end of slots 122 and 124, moving segmental gear 144 to a position in which it is out of engagement with gear 140. This causes roller 46 to fall out of the cassette 28, permitting its easy removal.

It will be seen that I have accomplished the objects of my invention. I have provided an automatic biasing mechanism for a paper cassette support plate which does not interfere with the insertion and removal of the cassette and, in fact, is rendered operative by the insertion of the cassette in a machine and inoperative by the removal of the cassette from the machine. In addition my automatic biasing mechanism maintains the plate at the proper height without the use of excessive force against the feed roller assembly.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for positioning the top sheet of a stack of sheets at a predetermined location on a machine frame adapted removably to receive a stack-supporting tray including in combination, a frame, means on said frame for removably receiving a stack-supporting tray, means including a pair of interengageable elements for acting on a stack of sheets in a tray on said receiving means to position the top sheet of the stack at said predetermined location, means mounting said interengageable elements on said frame for relative movement between a disengaged position on said frame and an engaged position on said frame, means for biasing said elements to said disengaged position on said frame in the absence of said tray on said supporting means and means responsive to positioning of a stack-supporting tray on said receiving means for moving said elements to said engaged position against the action of said biasing means.

2. Apparatus for positioning the top sheet of a stack of sheets at a predetermined location on a machine frame adapted removably to receive a stack-supporting tray including in combination, a frame, means on said frame for removably receiving a stack-supporting tray, means including a pair of interengageable elements for acting on a stack of sheets in a tray on said receiving means to position the top sheet of the stack at said predetermined location, means mounting said interengageable elements on said frame for relative movement between a disengaged position on said frame and an engaged position on said frame, means for biasing said elements to said disengaged position on said frame in the absence of said tray on said supporting means, means responsive to positioning of a stack-supporting tray in said receiving means for moving said elements to said engaged position against the action of said biasing means, and means for holding said tray in position on said receiving means against the action of said biasing means.

3. Apparatus for positioning the top sheet of a stack of sheets in a stack-supporting tray at a predetermined location on a machine frame including in combination, a frame, means on said frame for removably receiving a stack-supporting tray, means for acting on a stack of sheets in a tray on said receiving means to position the top sheet of the stack at said predetermined location, said top sheet positioning means comprising a first gear, a second gear, a shaft supporting said second gear, means mounting said shaft on said frame for movement between a first position at which said gears are out of mesh, and a second position at which said gears are in mesh and means biasing said shaft to said first position, and interengageable means on said tray and on said shaft for moving said shaft to said second position against the action of said biasing means in response to positioning of said tray in said receiving means.

4. Apparatus for feeding sheets one at a time from the top of a stack of sheets in a stack-supporting tray with the top sheet of the stack positioned at a predetermined location on a machine frame including in combination, a frame, a sheet pick-off roller, means mounting said roller on said frame for swinging movement toward and away from said location, means on said frame for removably receiving a stack-supporting tray, means including a drive motor and a pair of gears for acting on a stack in said receiving means to move the top sheet toward said location, means mounting said gears on said frame between a first relative position at which said gears engage and a second relative position at which said gears are disengaged, means for biasing said gears to said second position, means responsive to placement of a tray in said receiving means for moving said gears to said second relative position, means for energizing said motor to cause said top sheet to move to said location, and means responsive to movement of said roller under the action of said stack for deenergizing said motor with said top sheet at said location.

5. Apparatus for positioning the top sheet of a stack of sheets at a predetermined location on a machine frame including in combination, a frame, a tray for supporting a stack of said sheets, means on said frame for removably receiving said tray, means including a driving train on said frame for acting on a stack of sheets in a tray on said frame to position the uppermost sheet at said location, means on said frame for interrupting said drive train in the absence of said tray on said frame, and means responsive to insertion of said tray in said receiving means for disabling said interrupting means to establish said driving train.

6. Apparatus for positioning the top sheet of a stack of sheets in a stack-supporting tray at a location on a machine frame from which the sheets are fed including in combination, a frame, a tray for supporting said stack of sheets, means on said frame for removably receiving a stack-supporting tray, means including an energizable element and a driving train for acting on a stack in a tray on said receiving means to position the uppermost sheet at said location, means on said frame for interrupting said driving train in the absence of a tray in said receiving means, means for energizing said energizable element and means responsive to insertion of a tray in said receiving means for disabling said interrupting means to establish said driving train.

* * * * *

UNITED STATES PATENT AND TRADEMARK OFFICE

CERTIFICATE OF CORRECTION

PATENT No. : 4,506,877

DATED : March 26, 1985

INVENTOR(S): SAGIV, O.

It is certified that error appears in the above-identified patent and that said Letters Patent is hereby corrected as shown below:

In claim 4, column 6, line 7, change "second" to --first--.

Signed and Sealed this

Sixth Day of May, 1997

*Attest:*

*Attesting Officer*

BRUCE LEHMAN

*Commissioner of Patents and Trademarks*